US011371231B2

(12) United States Patent
Choi et al.

(10) Patent No.: US 11,371,231 B2
(45) Date of Patent: Jun. 28, 2022

(54) TOILET FLUSHING DEVICE USING TOILET COVER

(71) Applicants: Chang Hun Choi, Usan (KR); Sun Young Choi, Busan (KR)

(72) Inventors: Chang Hun Choi, Usan (KR); Sun Young Choi, Busan (KR)

( * ) Notice: Subject to any disclaimer, the term of this patent is extended or adjusted under 35 U.S.C. 154(b) by 0 days.

(21) Appl. No.: 17/047,372

(22) PCT Filed: Mar. 19, 2019

(86) PCT No.: PCT/KR2019/003207
§ 371 (c)(1),
(2) Date: Oct. 13, 2020

(87) PCT Pub. No.: WO2019/203458
PCT Pub. Date: Oct. 24, 2019

(65) Prior Publication Data

US 2021/0115654 A1 Apr. 22, 2021

(30) Foreign Application Priority Data

Apr. 19, 2018 (KR) ..... 10-2018-0045787

(51) Int. Cl.
*E03D 5/04* (2006.01)
*E03D 1/34* (2006.01)

(52) U.S. Cl.
CPC ..... *E03D 5/04* (2013.01); *E03D 1/34* (2013.01)

(58) Field of Classification Search
CPC ..... E03D 5/02; E03D 5/04; E03D 1/34
See application file for complete search history.

(56) References Cited

U.S. PATENT DOCUMENTS 1,224,734 A * 5/1917 Gallagher ..... E03D 5/04 4/330
5,319,810 A * 6/1994 Metzger ..... E03D 5/04 4/246.2

(Continued)

FOREIGN PATENT DOCUMENTS

KR 20-1998-0063870 U 11/1998
KR 19980063870 U 11/1998

(Continued)

OTHER PUBLICATIONS

KR Office Action dated Jun. 19, 2018 as received in Application No. 10-2018-0045787.

(Continued)

*Primary Examiner* — David P Angwin
*Assistant Examiner* — Nicholas A Ros
(74) *Attorney, Agent, or Firm* — Maschoff Brennan

(57) ABSTRACT

The present invention relates to a toilet flushing device using a toilet cover. More specifically, the present invention comprises: a sliding means disposed at the front side of a water tank and configured to slide forward/backward by magnetic force to allow a drain valve to operate as soon as a toilet cover is closed; and an operation lever disposed at the rear side of the sliding means so as to open or close the drain valve, wherein the drain valve is operated to flush water by a structure in which the sliding means and the operation lever operate in cooperation in response to an operation of the toilet cover after use of the toilet. Therefore, the present invention can induce the habit of covering the toilet by the toilet cover after using the toilet and thus enhance a sanitary culture.

6 Claims, 10 Drawing Sheets

(56) References Cited

U.S. PATENT DOCUMENTS

| | | | | |
|---|---|---|---|---|
| 9,506,232 | B2 * | 11/2016 | Terry | E03D 5/04 |
| 11,105,079 | B1 * | 8/2021 | Woodring | E03D 5/026 |
| 2014/0338113 | A1 | 11/2014 | Terry | |
| 2015/0035216 | A1 * | 2/2015 | Swendsen | A01M 31/00 269/289 R |

FOREIGN PATENT DOCUMENTS

| | | | |
|---|---|---|---|
| KR | 10-2016-0037049 | A | 5/2016 |
| KR | 10-1621906 | B1 | 5/2016 |
| KR | 10-2016-0055022 | A | 9/2016 |
| KR | 10-1653379 | B1 | 9/2016 |
| KR | 10-2017-0049334 | A | 5/2017 |
| KR | 10-1785037 | B1 | 10/2017 |

OTHER PUBLICATIONS

KR Decision to Grant dated Jul. 30, 2018 as received in Application No. 10-2018-0045787.

* cited by examiner

[FIG. 1]
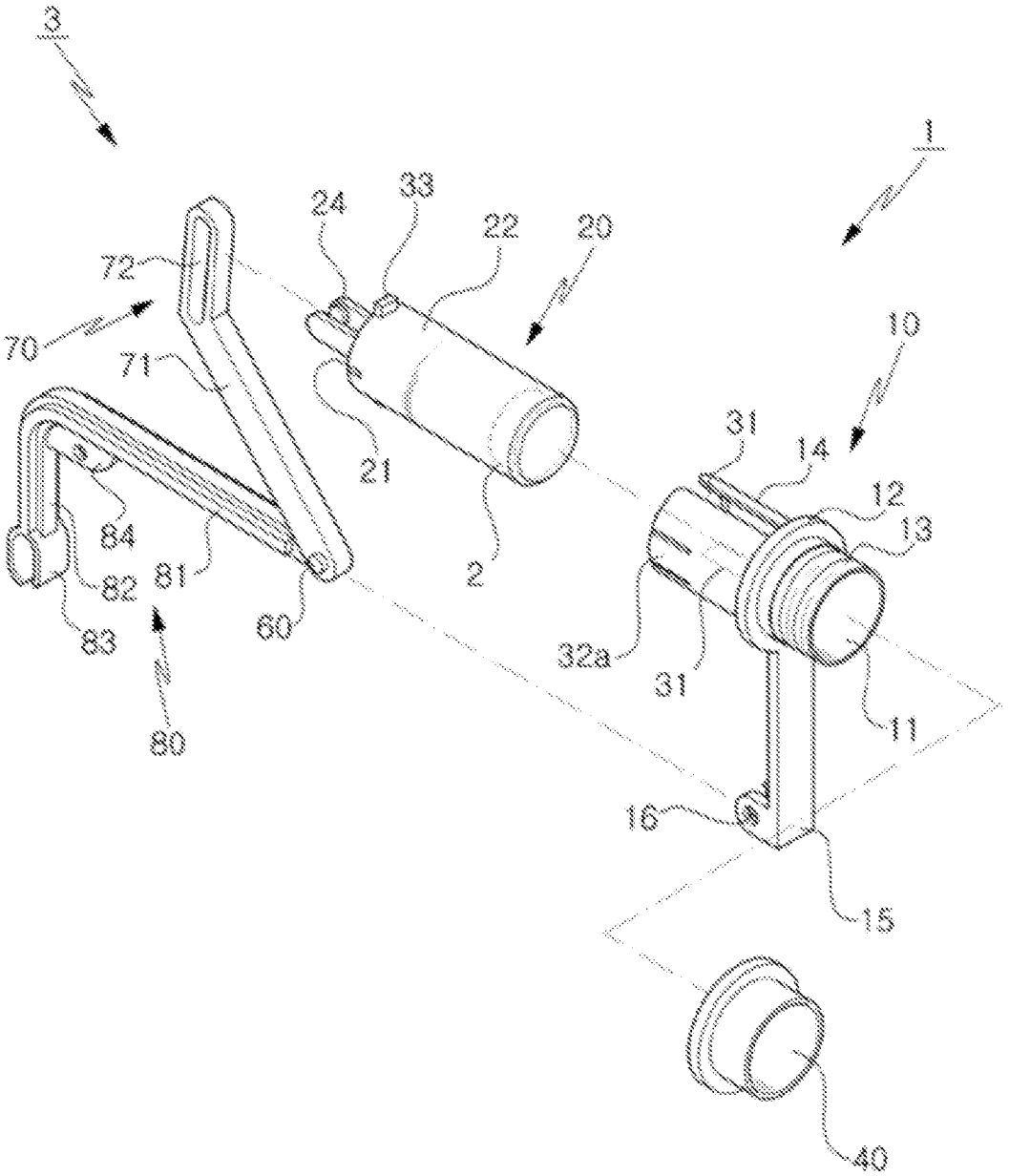

[FIG. 2]
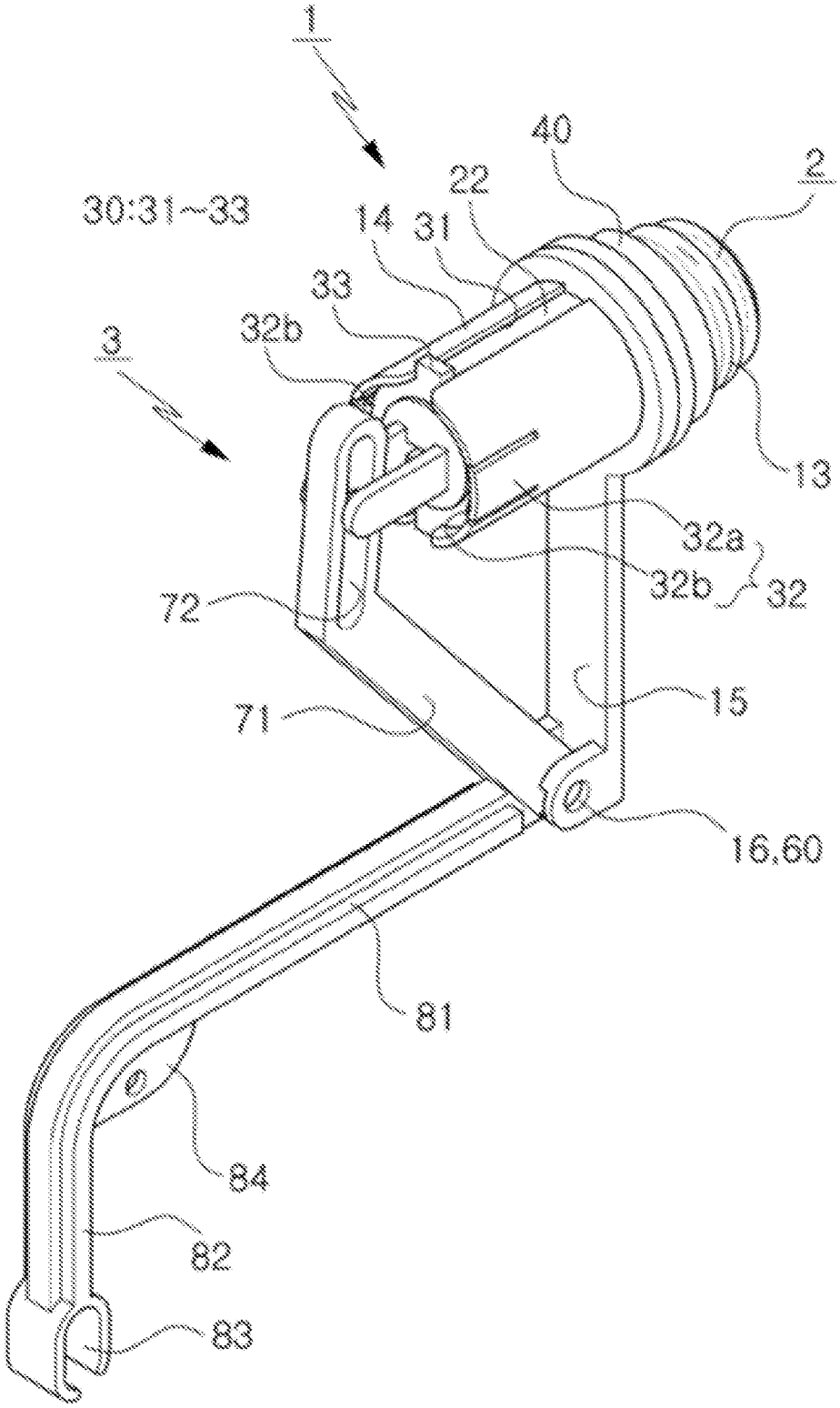

[FIG. 3]
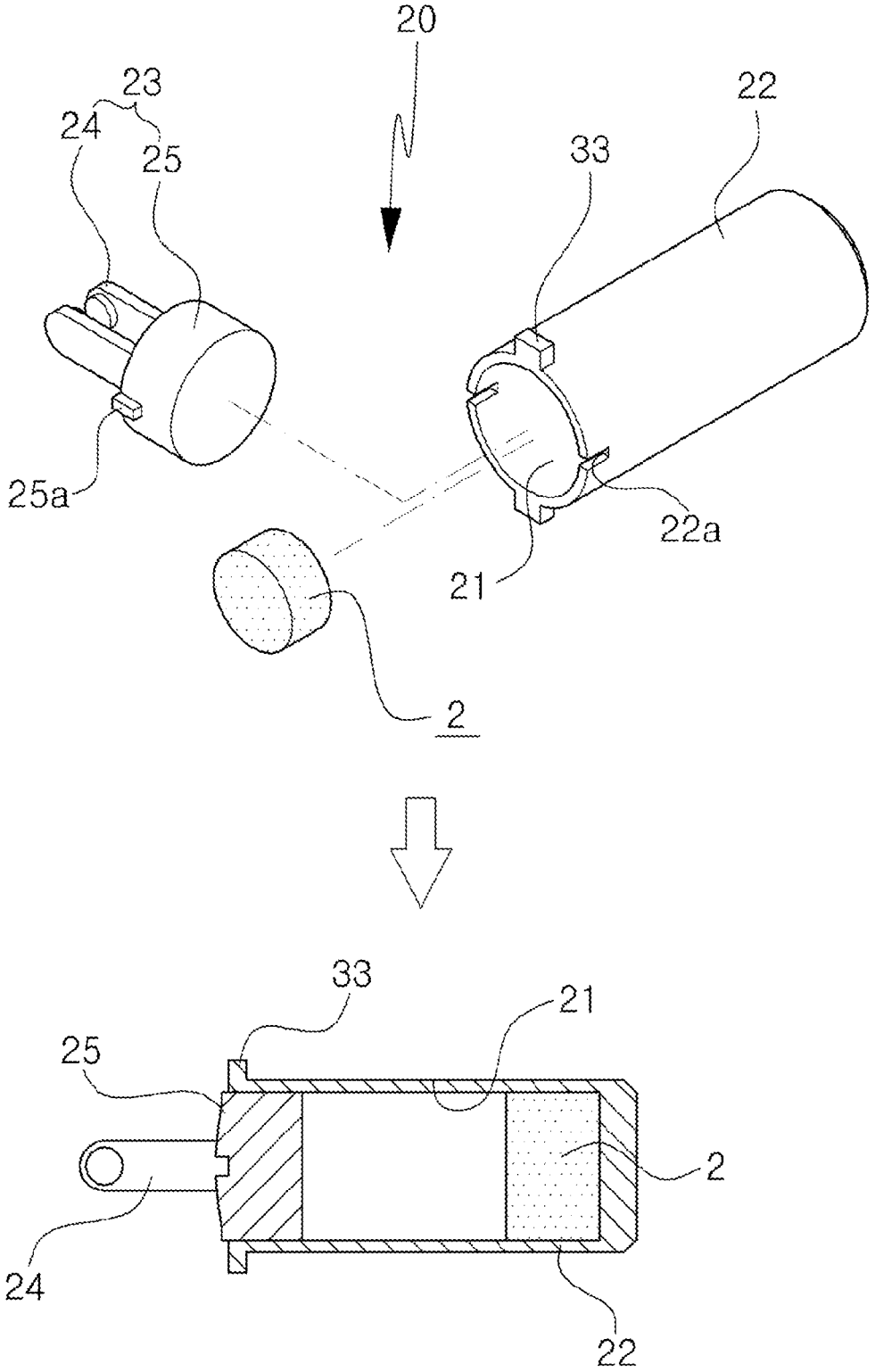

[FIG. 4]
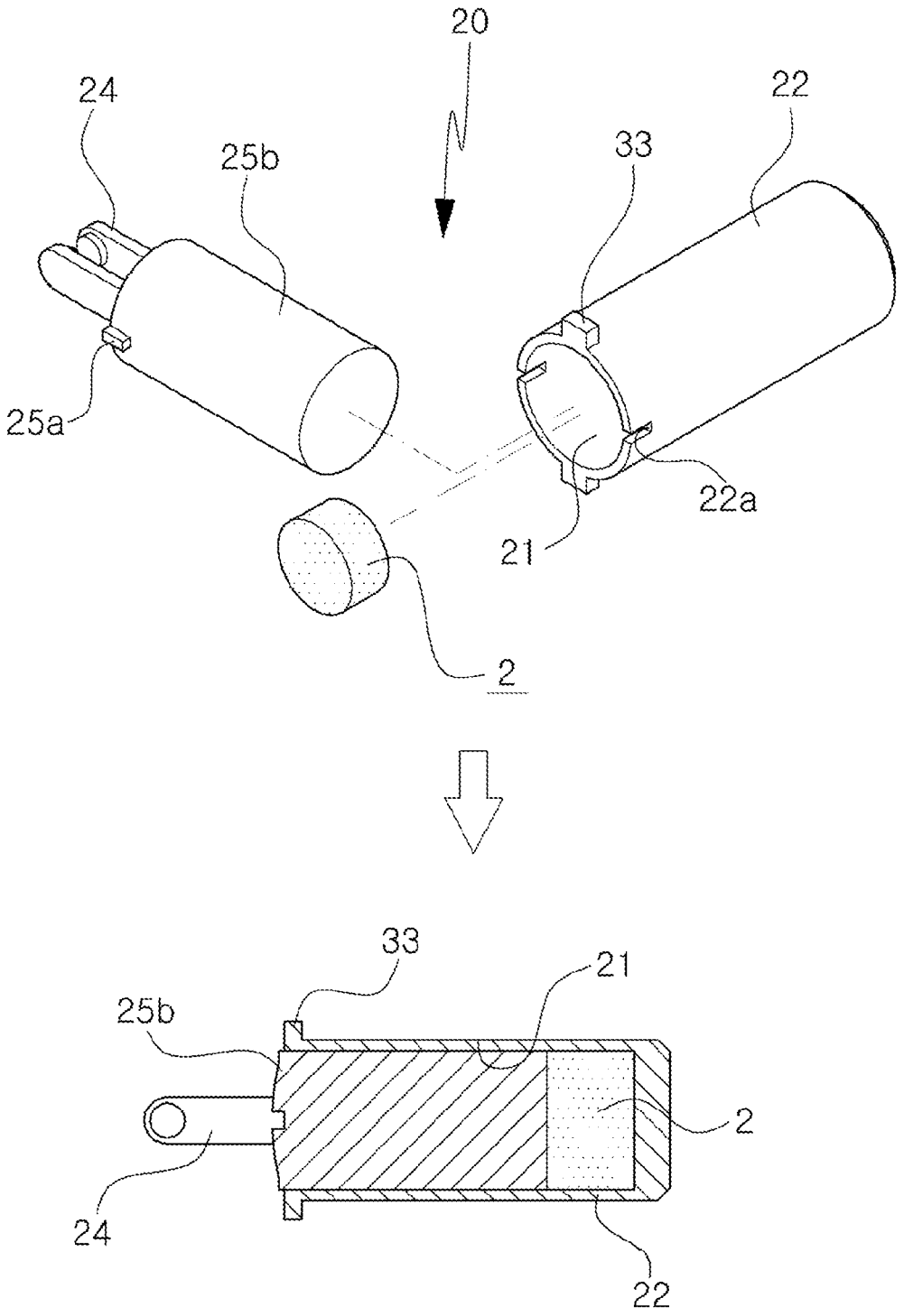

[FIG. 5]
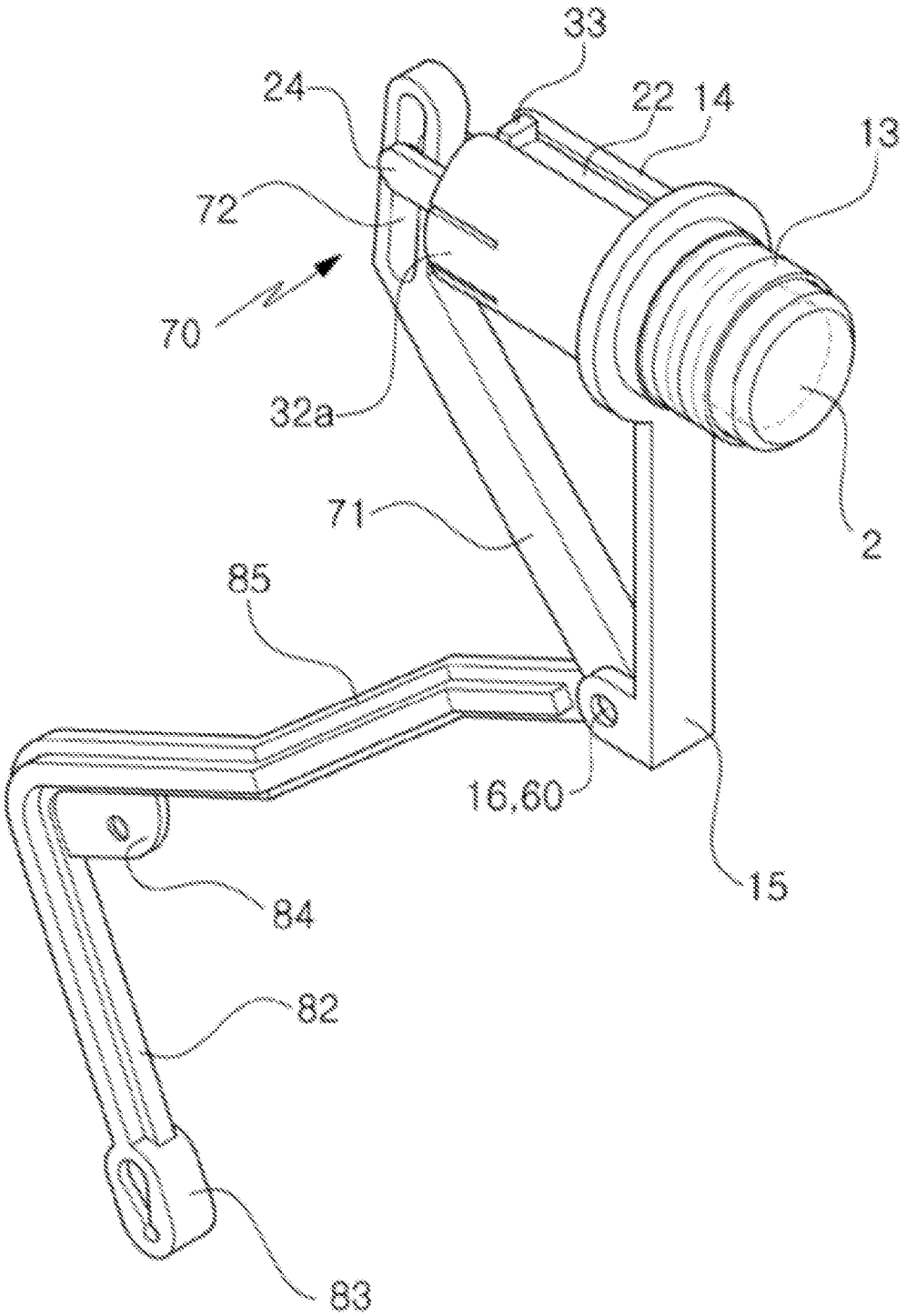

[FIG. 6]
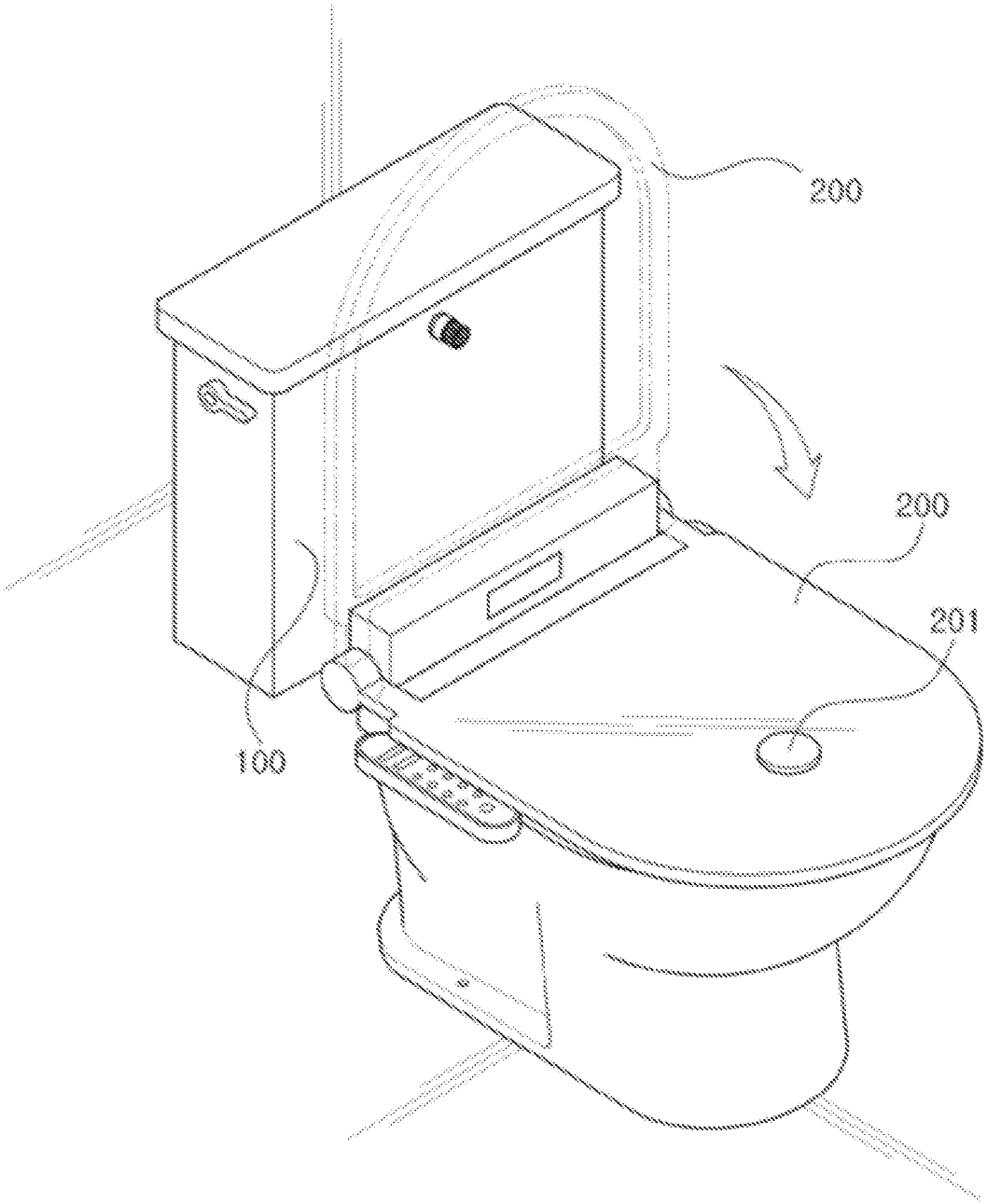

[FIG. 7]
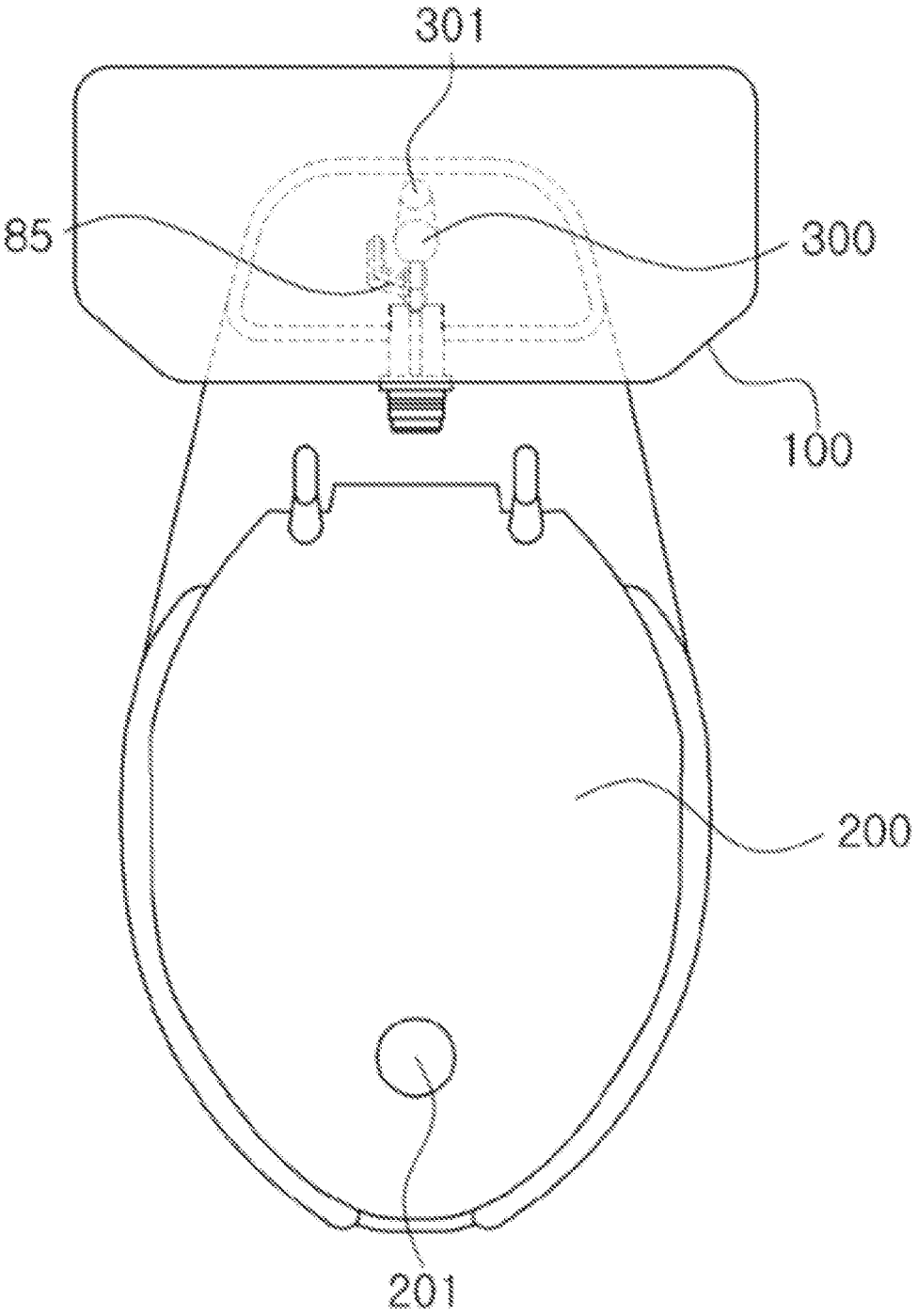

[FIG. 8]
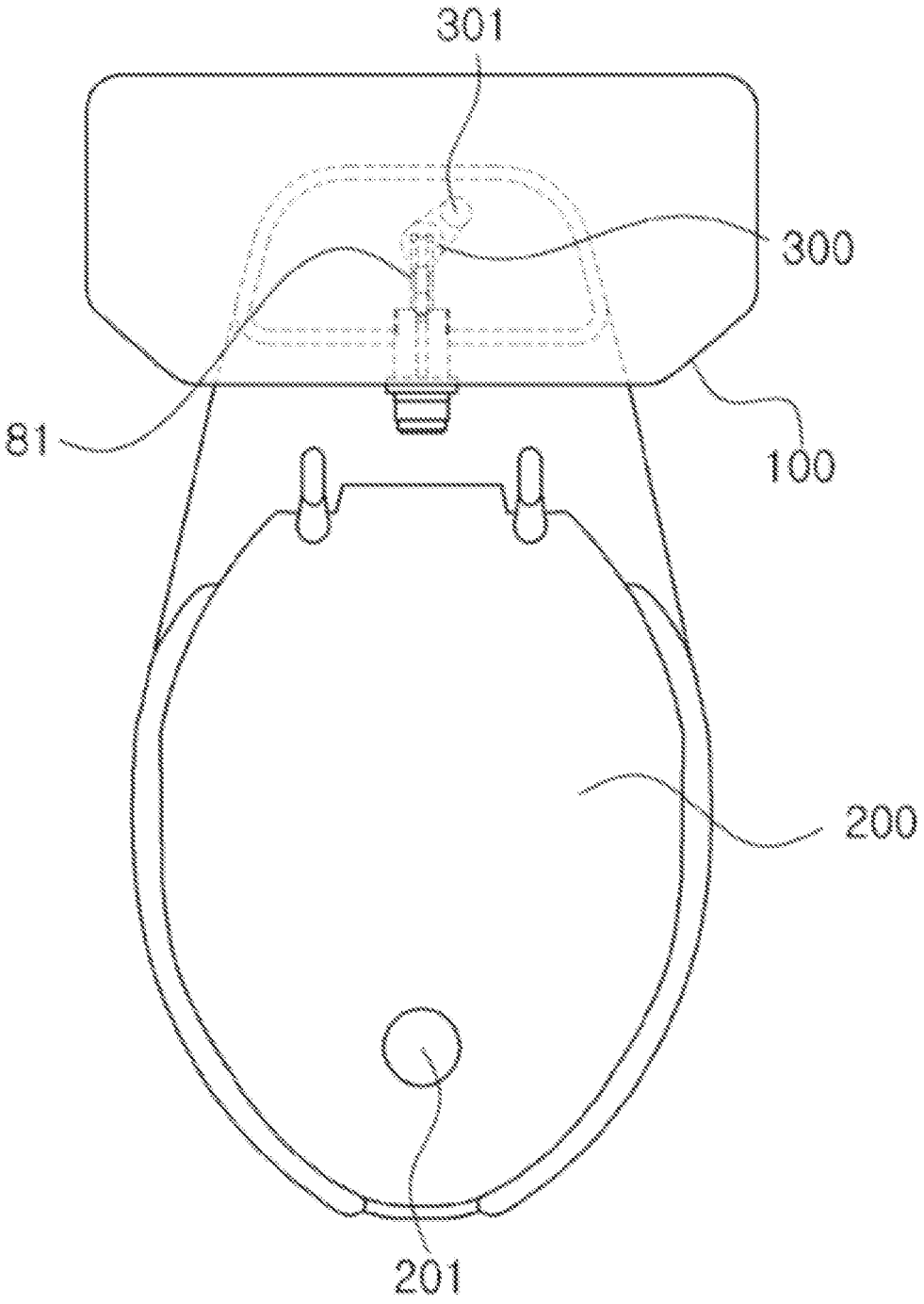

[FIG. 9]
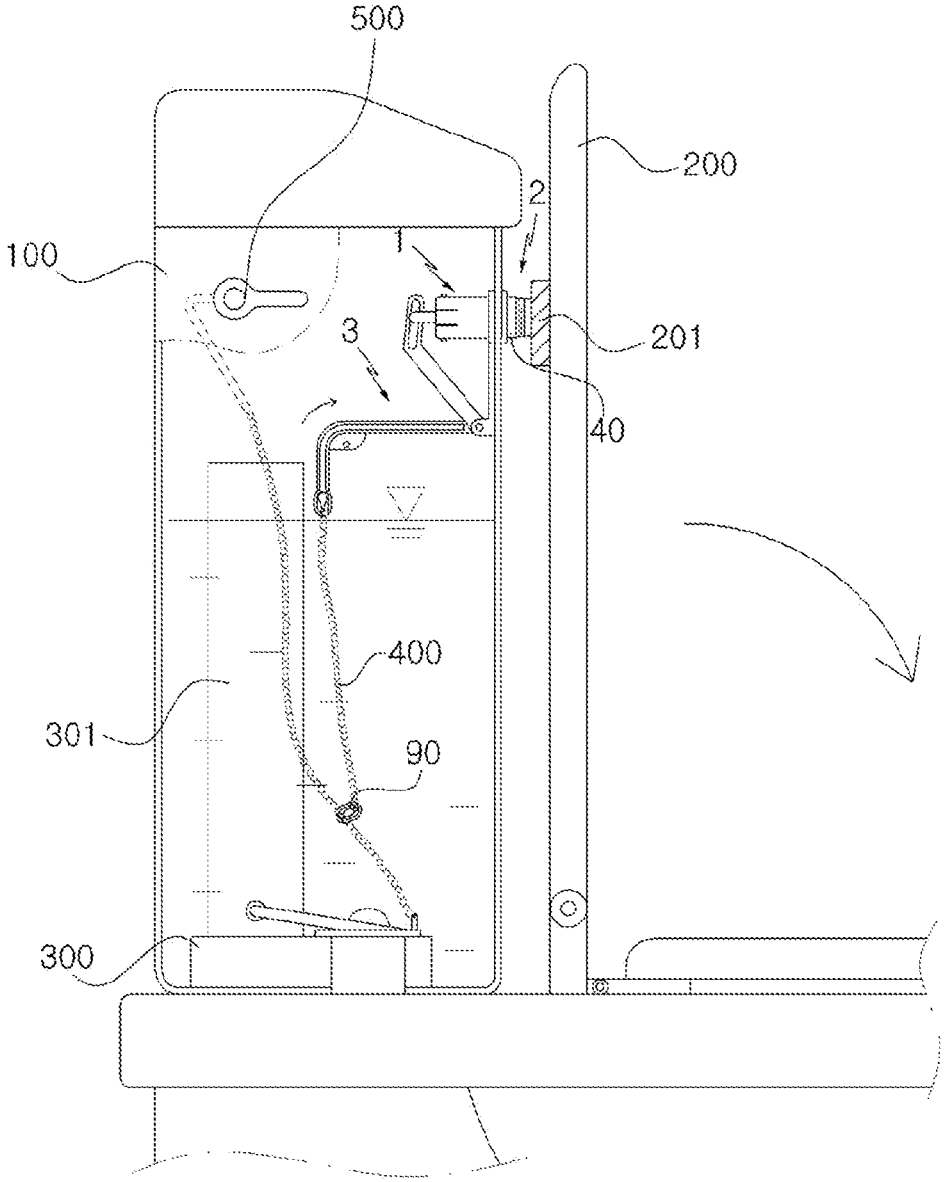

[FIG. 10]
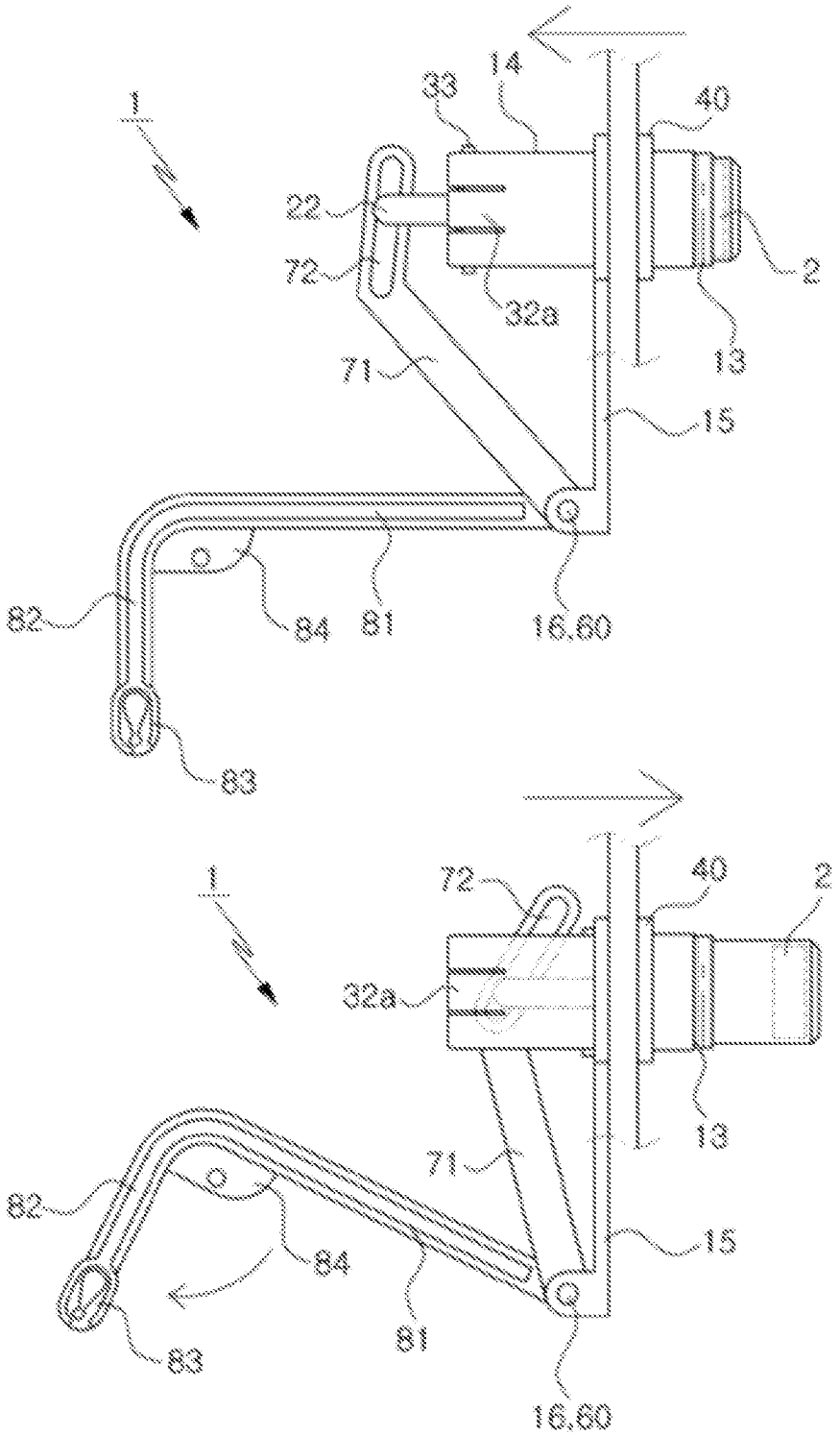

TOILET FLUSHING DEVICE USING TOILET COVER

FIELD OF INVENTION

The present invention relates to a toilet flush device using a toilet lid that operates a drain valve while closing a toilet seat at the same time, in order to flush water after use by means of the toilet lid, and therefore, to induce a habit of closing the toilet seat with the toilet lid after defecating, thereby improving hygienic toilet management.

BACKGROUND OF INVENTION

In general, a toilet bowl installed in a bathroom of a house or a public place has a structure in which excreta are discharged to a septic tank while the washing water is drained by pressing a button or a lever after use. The drain valve for draining the washing water stored in a water tank of the toilet is typically a button-type or lever-type structure directly operated by a user.

However, in the prior art, a toilet is commonly flushed without putting a toilet lid down. As a result, during aeration of the washing water, there is a problem that harmful bacteria are spread to the air outside the toilet bowl and then in the air. Accordingly, the inside of a toilet stall is contaminated with the harmful bacteria, hence threatening the user's health and causing sanitation problems.

In order to solve such problems, a technique for leading the toilet seat to be closed with the toilet lid in conjunction with operation of the drain valve after use has been disclosed.

According to a drain valve switching device for a toilet bowl using magnetic force disclosed in Korean Patent No. 10-1621906 (prior document 1), the drain valve switching device is based on a technique characterized in that a drain valve for switching (opening/closing) a drain port inside a water tank is connected to a drive line and, when the drive line is pulled, the drain port is opened to drain water, and comprises: a connection member for guiding the drive line connected to the drain valve to be drawn in and out; a weight body coupled to the drive line in the water tank, which has a predetermined weight; a close contact member which is formed to be connected to the drive line through the connection member and is exposed to the outside of the water tank; and a fixing member formed and fixed at a predetermined position of the toilet lid in order to correspond to the contact member, wherein the contact member and the fixing member are made of magnetic bodies, in particular, at least one of the contact member and the fixing member is made of a magnet, and the contact member and the fixing member are configured to be attached to or detached from each other by opening and closing the toilet lid, thus enabling the toilet lid to be closed by a user after use.

However, the above prior document 1 has a problem in that the drain valve is not smoothly switched and has deteriorated durability, since the drive line is connected to be bent at 90 degrees to the connection member in a structure in which the drive line connecting the drain valve and the magnetic body is connected by the weight body.

According to an automatic toilet flush device disclosed in Korean Patent No. 10-1785037 (prior document 2), the flush device to flow washing water stored in a water tank after defecating comprises: a coupling member mounted on the front of the water tank; a pole button for actuating an operation lever while moving back and forth inside the coupling member; and a pulling means mounted on a toilet lid to pull the pole button, and is based on a technique characterized in that water flows upon closing the toilet lid, which in turn leads to a simple configuration and structure with high durability and promotes a habit of closing the toilet lid, thereby achieving enhanced hygiene and cleanliness of the toilet.

The prior document 2 has proposed a technique known by the present inventors, and disclosed a combined structure of: the pole button sliding by magnetic force; a horizontal link; and a rotatable link that enables simultaneous switching motion of the toilet lid and a siphon stopper, thereby inducing the toilet lid to be closed. However, the sliding pole button structure has somewhat deteriorated durability and a configuration of the operation lever with the horizontal link and the rotatable link has a disadvantage of somewhat cumbersome manufacture and assembly.

SUMMARY OF INVENTION

Technical Problem to be Solved

Therefore, the present invention has been devised as a novel technical art to overcome the aforementioned problems of the prior art, and an object of the present invention is to provide a toilet flush device using a toilet lid, characterized in that, in order to achieve a toilet culture to guide a toilet seat to be closed after use, switching a drain valve is operated in conjunction with a toilet lid, and a simple and convenient assembly structure of the sliding means to slide by magnetic force as well as a configuration of not deteriorating durability are adopted, thereby improving user convenience and hygienic management of the toilet.

Technical Solution

In order to solve the above problems, the toilet flush device of the present invention is provided with a specific means, that is, a sliding means, including: a slide guide member in which an insert screwed with a fastening nut protrudes from a front end of a locking flange in order to be coupled while penetrating the inside/outside of a water tank, a slide guide pipe protrudes from a rear end of the locking flange, and a hinge support having a hinge groove at a lower end thereof is formed on a lower part of the locking flange; a sliding pole in which a magnetic body detachably adhered to a corresponding attachment member of a toilet lid is inserted into a front side of the sliding pole so as to enter the slide guide member and move back and forth, and an operation lever is hinged at a rear side of the sliding pole; and an anti-release member to prevent the sliding pole from being released from the front and rear sides of the slide guide member when the sliding pole moves back and forth.

Further, the sliding pole may include: a slide body having an insert groove opened at the rear side so that the magnetic body is inserted and coupled to an inner front end of the slide body; and a hinge member coupled to the rear side of the slide body so that the operation lever is hinged to the hinge member, wherein the hinge member has a hinge ring formed at the rear side, to which a top side of the operation lever is hinged, and a coupler is provided on the front end in order to be fitted into and coupled to the insert groove of the slide body.

Further, the anti-release member may include: a longitudinal rail hole ("rail hole") opened at a rear side thereof, which is formed on upper and lower portions of the slide guide pipe; an anti-backward release body formed at both rear ends of the slide guide pipe in order to prevent backward release of the sliding pole; and a slider projection formed at the rear upper and lower sides of the sliding pole to be inserted into the rail hole and guided, so as to prevent forward release of the sliding pole while supporting straight movement thereof to the front and rear sides.

In addition, the anti-backward release body may include: a support piece having upper and lower incisions formed at both rear ends of the slide guide pipe; and a locking part formed to protrude inward at an end of the support piece.

Further, the operation lever may include: a seesaw type hinge member hinged to a hinge groove of the slide guide member; an upper link hinged to the rear end of the sliding pole on an upper side relative to the seesaw type hinge member in order to move back and forth; and a lower link connected to a drain valve through a connection line at the lower side in order to reciprocate up and down, thereby opening and closing the drain valve.

Further, the upper link may include: a ramp formed to incline upward from the seesaw type hinge member; and a longitudinal slide hole ("slide hole") hinged to the rear end of the sliding pole on top of the ramp in order to move back and forth along the rail hole by operating the sliding pole back and forth.

Effect of Invention

The toilet flush device using a toilet lid according to the present invention may guide the toilet seat in the closed state at all times by the toilet lid, so as to solve a problem of contaminating air in a toilet stall, in particular, to guide water flowing while covering the toilet seat, thereby attaining effects of improving cleanliness.

Further, since a simple structure of interlocking the toilet lid and the operation lever by means of a sliding means to slide by magnetic force on the front of the water tank so as to switch (that is, open and close) the drain valve is adopted, the inventive device is easily installed and applied, and may achieve excellent durability leading to effects of semi-permanent use.

BRIEF DESCRIPTION OF DRAWINGS

FIG. 1 is an exploded perspective view illustrating the toilet flush device using a toilet lid according to the present invention.

FIG. 2 is a combined perspective view illustrating the toilet flush device using a toilet lid according to the present invention.

FIG. 3 and FIG. 4 are perspective views illustrating in detail a configuration of the sliding pole in the configuration of the present invention.

FIG. 5 is a perspective view illustrating a modified embodiment of the operation lever in the configuration of the present invention.

FIG. 6 illustrates a state of using the toilet flush device with a toilet lid according to the present invention.

FIG. 7 and FIG. 8 illustrate installation examples of the toilet flush device according to the present invention in relation to a position of a water overflow pipe in a toilet bowl.

FIG. 9 illustrates a state of installing the toilet flush device using a toilet lid according to the present invention.

FIG. 10 illustrates operation of the toilet flush device shown in FIG. 9.

DETAILED DESCRIPTION OF PREFERRED EMBODIMENTS OF INVENTION

Hereinafter, the present invention will be described in detail with reference to specific embodiments in the accompanying drawings. FIG. 1 is an exploded perspective view illustrating the toilet flush device using a toilet lid according to the present invention, and FIG. 2 is a combined perspective view illustrating the toilet flush device using a toilet lid according to the present invention.

The toilet flush device using a toilet lid according to the present invention may include: a sliding means 1 formed on a front end of a water tank 100 in order to move back and forth; a magnetic body 2 provided on a front end of the sliding means 1 and detachably adhered to a corresponding attachment member 201 of a toilet lid 200, which interlocks the toilet lid 200 and the sliding means 1 by magnetic force; and an operation lever 3 provided at a rear side of the sliding means 1 in order to switch (open and close) a drain valve 300.

Referring to FIG. 1 and FIG. 2, the sliding means 1 may include: a slide guide member 10 fixedly installed to penetrate a front end of the water tank 100; a sliding pole 20 that is inserted into the slide guide member 10 and moves back and forth; and an anti-release member 30 to limit movement of the sliding pole 20, in order to prevent the sliding pole from flowing and being released back and forth.

The slide guide member 10 may include: a slide hole 11 formed to penetrate the slide guide member; an insert 13 screwed with a fastening nut 40, which protrudes from a front end of a locking flange 12 in order to be coupled while penetrating the inside/outside of the water tank 100; a slide guide pipe 14 protruding at a predetermined length from a rear end of the locking flange 12; and a hinge support 15 protruding downward to a lower side of the locking flange 12, which has a hinge groove 16 at a lower end of the hinge support 15.

Referring to FIG. 3, the sliding pole 20 may be provided with a slide body 22 that is inserted into the slide hole 11 to slide back and forth and has an insert groove 21 opened at the rear side, through which the magnetic body 2 is inserted and disposed at an inner front end thereof; and a hinge part 23 coupled to the rear side of the slide body 22 so that the operation lever 3 is hinged to the hinge part.

The hinge part 23 is fitted and coupled to a rear end of the sliding pole 20, and may include: a hinge ring 24 protruding from the rear side thereof, to which the operation lever 3 is hinged; and a coupler 25 protruding from the front side thereof, which is fitted and coupled to the insert groove 21 of the slide body 22.

In order to prevent the hinge part 23 from being pulled out of the slide body 22 while securing a direction of the hinge ring 24 when the hinge part 23 is coupled to the rear side of the slide body 22, the sliding pole 20 has an assembly groove **22*a* at both rear ends of the slide body 22, and a fitting assembly 25*a* protruding from both sides of the coupler 25**.

Meanwhile, the magnetic body 2 is adhered to a front end of the insert groove 21 by an adhesive, so as to be easily secured when the magnetic body 2 is inserted into the slide body 22 of the sliding pole 20, thereby inhibiting flow thereof.

Further, as shown in FIG. 4, a support **25*b* may be extended at an inner front side of the slide body 22 to closely support a rear end of the magnetic body 2 by extending the coupler 25 of the hinge part 23 to easily secure the magnetic body 2**.

The support **25*b* may inhibit the magnetic body 2 from flowing in the insert groove 21 and, at the same time, may closely adhere and support the magnetic body 2 to an inner front side of the slide body 22**, thereby enabling the magnetic body to sufficiently impart magnetic force.

The anti-release member 30 may include: a longitudinal rail hole ("rail hole")(31,31') opened at a rear side thereof, which is formed on upper and lower portions of the slide guide pipe 14; an anti-backward release body 32 formed at both sides of the slide guide pipe in order to prevent backward release of the sliding pole 20; and a slider projection 33 formed on rear upper and lower portions of the sliding pole 20 to be inserted into the rail hole 31, 31' and guided.

The anti-backward release body 32 may include: a support piece 32*a* having upper and lower incisions provided at both rear ends of the slide guide pipe 14; and a locking part 32*b* formed to protrude inwardly at an end of the support piece 32*a*, wherein, when the sliding pole 20 is assembled to be inserted into the slide guide member 10, the support piece 32*a* is expanded outward or retracted by a predetermined elastic restoration force and holds the sliding pole to lock the same at the rear side when the sliding pole 20 slides back and forth, thereby preventing the same from being pulled out.

The slider projection 33 may prevent forward release of the sliding pole 20 from the slide guide pipe 14 and, at the same time, may be integrated with upper and lower edges at the rear side of the slide body 20, thus guiding straight reciprocation of the sliding pole without flowing.

The magnetic body 2 is integrally formed while being inserted into the inner front end of the sliding pole 20 to act with a retraction force when closing the toilet lid 200, whereby the sliding pole 20 is interlocked by magnetic force.

Further, in order to attach the magnetic body 2 to the toilet lid 200, a corresponding attachment member 201 is installed on the toilet lid 200 to be detachable in response to the magnetic body 2. In order to improve adhesion, the attachment member 201 may be configured to be proportional to a diameter of the magnetic body 2. Further, the attachment member 201 may be provided in the form protruding or embedded in the toilet lid 200.

The operation lever 3 may be configured to connect the sliding pole 20 and the drain valve 300 such that the drain valve 300 of the water tank is interlocked with forward or backward movement of the sliding pole 20 by the magnetic body 2 pulled due to the magnetic force when the toilet lid 200 is closed.

To this end, the operation lever 3 may include: a seesaw type hinge member 60 hinged to the hinge groove 16 of the hinge support 15; an upper link 70 connected to the hinge part 23 at the rear end of the sliding pole 20 on an upper side relative to the seesaw type hinge member 60; and a lower link 80 connected to the drain valve 300 at a lower side through a connection line 400.

The upper link may include a ramp 71 formed to incline upward from the seesaw type hinge member 60, and a longitudinal slide hole ("slide hole") 72 perpendicular to a top end of the ramp 71.

The lower link 80 may include: a horizontal stand 81 protruding in a horizontal direction from the seesaw type hinge member 60; a vertical stand 82 bent vertically downward from the horizontal stand 81; a coupling hole 83 to which the connection line 400 is coupled in order to connect the drain valve 300 to a bottom end of the vertical stand 82; and a reinforcing rib 84 for supporting rigidity between the horizontal stand 81 and the bent vertical stand 82.

In the operation lever 3 as described above, the upper link 70 is hinged to the sliding pole 20 to reciprocate the lower link 80 up and down while moving back and forth simultaneously, thereby switching the drain valve 300, wherein the hinge support 15 and the seesaw type hinge member 60 support reciprocal action in a principle of lever motion between the upper link 70 and the lower link 80, thereby leading to smooth switching operation.

Meanwhile, as shown in FIG. 5, the lower link 80 of the operation lever 3 may be modified to have a structure wherein a horizontal ramp 85 having an inclined angle in planar view from the seesaw type hinge member 60 is provided in place of the horizontal stand 81, so as to avoid interference depending upon a position of a water overflow pipe 301 during reciprocation, and the vertical stand 82 is bent vertically downward from the horizontal ramp 85.

Hereinafter, operation of the toilet flush device using a toilet lid according to the present invention will be described.

FIG. 6 illustrates a state of using the present invention, wherein the toilet flush device of the present invention is interlocked with motions of opening and closing a toilet lid 200 to flow water, when the inventive device is mounted to penetrate a front center of the water tank 100. In other words, when the toilet lid 200 is flipped toward the water tank 100, the attachment member 201 previously mounted on the toilet lid 200 is adhered to the magnetic body 2 due to magnetic force. Then, when flipping down the toilet lid 200 again to close the same after use, the toilet flush device is simultaneously operated to flow water. Accordingly, a user naturally recognizes that the toilet flush device is interlocked with closing the toilet lid 200, thereby guiding the toilet seat to be closed by the toilet lid whenever the toilet is flushed or not in use.

Referring to FIG. 7 and FIG. 8, when the toilet flush device of the present invention is mounted on the water tank 100, this device can afford smooth operation by avoiding interference of the operation lever 3 depending on a position of the water overflow pipe 301.

In other words, FIG. 7 illustrates use of the lower link 80 of the operation lever 3, which is configured of a straight horizontal stand 81, in case of a structure wherein the water overflow pipe 301 is disposed in a diagonal direction. On the other hand, FIG. 8 illustrates use of the lower link 80 of the operation lever 3, which is configured of a horizontal ramp 84 having an inclined angle, in case of an alternative structure wherein the water overflow pipe 301 is disposed at the center.

FIG. 9 and FIG. 10 illustrate a specific operation state of the toilet flush device of the present invention, wherein the sliding means 1 is installed to penetrate the inside and outside of the water tank 100, and includes: a sliding pole 20 to linearly reciprocate back and forth inside the slide guide member 10; and the operation lever 3 hinged at the rear side of the sliding pole 20 and connected through a connection line 400 in order to switch the drain valve 300. Further, upon opening and closing the toilet lid 200, the sliding pole 200 is reciprocated by magnetic force of the magnetic body 2 and, at the same time, the drain valve 200 is switched by the operation lever 3.

In order to flow water, the toilet is used by a user in a state in which the toilet lid 200 is attached to the magnetic body 2 and, when the toilet lid 200 is pulled to a toilet seat after use in order to close the toilet seat, the sliding pole 20 attached by magnetic force of the magnetic body 2 slides forward along the toilet lid 200 due to pulling force. Simultaneously, the operation lever 3 hinged to a rear end of the sliding pole 20 acts such that the upper link 70 moves forth along the sliding pole 20 relative to the seesaw type hinge member 60 while the lower link 80 on a lower side of the seesaw type hinge member 60 is lifted and reciprocates, simultaneously, so as to lift the drain valve 300 connected through the connection line 400, thus flowing water.

Then, after the drainage process, the drain valve 300 naturally returns to the closed state, the lower link 80 moves downward, and the sliding pole 20 moves back and is returned to an original state thereof.

In this regard, because of a structure in which the upper link 70 is hinged to the hinge part 23 of the sliding pole 20 through the slide hole 72, the slide hole 72 may naturally move forth along the rail hole 31,31' of the slide guide pipe 14 upon forward movement of the sliding pole 20. For the operation lever 3, the seesaw type hinge member 60 acts in the principle of lever motion to smoothly reciprocate the lower link 80 up and down, thus overcoming a problem of deteriorating durability such as breaking of the operation lever 3 or the like.

Further, for operation of the sliding pole 20, the sliding pole moves back and forth in a configuration of the slider projection 33 inserted into the rail hole 31, 31'. Further, due to action of the anti-release member 30 consisting of the anti-backward release body 32 at a rear end of the slide guide pipe 14, the sliding pole may conduct straight movement without flowing and stably slide without being released back and forth within a limited distance of the rail hole 31, 31', thereby smoothly switching the drain valve 300.

On the other hand, the toilet flush device of the present invention may be used simultaneously with the existing water flowing lever 500 when the inventive device is installed in a toilet bowl. Herein, if the connection line 400 is connected to the lower link 80, an interlocking ring 90 may be simply fastened to the connection line 400 that connects the existing water flowing lever 500 and the drain valve 300, thereby completing installation.

As such, the toilet flush device using a toilet lid according to the invention as described above has a simple structure to achieve easy and convenient assembly. Further, a stable structure and action in conjunction with the toilet lid are provided so as to enable semi-permanent use. Especially, when the toilet bowl is not in use, the inventive device may lead the toilet seat to be always closed by the toilet lid. Therefore, it is possible to prevent bacteria propagation in a toilet stall due to the toilet bowl while further enhancing cleanliness of the toilet stall.

As described above, the detailed description of the present invention has been concretely illustrated with respect to the most preferred embodiment of the preset invention. However, various modifications may be made within the range not departing from the technical scope of the present invention. Therefore, the protected scope of the present invention is not limited to the examples described above and, instead, it will be recognized that technologies in the appended claims below and equivalent technical means thereof are also included in the scope of the present invention.

INDUSTRIAL APPLICABILITY

The present invention enables the drain valve to be operated upon closing the toilet seat with the toilet lid so that water can flow using the toilet lid after use. Further, a habit of closing the toilet seat with the toilet lid is induced to create a clean and hygienic toilet culture, thereby attaining very high industrial availability.

The invention claimed is:

1. A toilet flush device using a toilet lid, which includes a sliding means, comprising:

a slide guide member in which:

an insert screwed with a fastening nut protrudes from a front end of a locking flange in order to be coupled while penetrating a inside/outside of a water tank, a slide guide pipe protrudes from a rear end of the locking flange, and a hinge support having a hinge groove at a lower end thereof is formed on a lower part of the locking flange;

a sliding pole in which:

a magnetic body magnetically attaches and detaches from a corresponding attachment member of a toilet lid is inserted into a front side of the sliding pole so as to enter the slide guide member and move back and forth, and an operation lever is hinged at a rear side of the sliding pole; and an anti-release member formed to prevent the sliding pole from being released from a front and rear sides of the slide guide member when the sliding pole moves back and forth.

2. The device according to claim 1, wherein the sliding pole includes:

a slide body having an insert groove opened at a rear side so that the magnetic body is inserted and coupled to an inner front end of the slide body; and a hinge member coupled to a rear side of the slide body so that the operation lever is hinged to the hinge member, wherein the hinge member has a hinge ring formed at a rear side of the hinge member, to which a top side of the operation lever is hinged, and a coupler provided on the front end of the hinge member in order to be fitted into and coupled to the insert groove of the slide body.

3. The device according to claim 1, wherein the anti-release member includes:

a longitudinal rail hole opened at a rear side thereof, which is formed on upper and lower ends of the slide guide pipe;

an anti-backward release body formed at opposite rear ends of the slide guide pipe in order to prevent backward release of the sliding pole; and a slider projection formed at a rear upper and lower sides of the sliding pole to be inserted into the rail hole and guided, so as to prevent forward release of the sliding pole while supporting straight movement thereof to an front and rear sides of the sliding pole.

4. The device according to claim 3, wherein the anti-backward release body includes:

a support piece having upper and lower incisions formed at opposite rear ends of the slide guide pipe; and a locking part formed to protrude inward at an end of the support piece.

5. The device according to claim 3, wherein the operation lever includes:

a seesaw type hinge member hinged to the hinge groove of the slide guide member;

an upper link hinged to the rear end of the sliding pole on an upper side relative to the seesaw type hinge member in order to move back and forth; and a lower link connected to a drain valve at a lower side of the lower link through a connection line in order to reciprocate up and down, thereby opening and closing the drain valve.

6. The device according to claim 5, wherein the upper link includes:

a ramp formed to incline upward from the seesaw type hinge member; and a longitudinal slide hole hinged to a rear end of the sliding pole on top of the ramp in order to move back and forth along the rail hole by operating the sliding pole back and forth.

* * * * *